US005881456A

United States Patent [19]

Bergins et al.

[11] Patent Number: 5,881,456

[45] Date of Patent: Mar. 16, 1999

[54] HEADER TUBES FOR HEAT EXCHANGERS AND THE METHODS USED FOR THEIR MANUFACTURE

[75] Inventors: Michael E. Bergins, Datteln; Peter Brede, Wuppertal, both of Germany

[73] Assignee: ARUP Alu-Rohr und Profil GmbH, Dortmund, Germany

[21] Appl. No.: 821,163

[22] Filed: Mar. 20, 1997

[51] Int. Cl.[6] ..... F28F 9/02

[52] U.S. Cl. ..... 29/890.052; 165/153; 165/173; 165/175; 165/906

[58] Field of Search ..... 165/151, 153, 165/173, 175, 906; 29/890.052

[56] References Cited

U.S. PATENT DOCUMENTS

| | | | |
|---|---|---|---|
| 4,150,556 | 4/1979 | Melnyk . | |
| 4,960,169 | 10/1990 | Granetzke . | |
| 5,052,480 | 10/1991 | Nakajima et al. | 165/153 |
| 5,297,624 | 3/1994 | Haussmann et al. | 165/173 |
| 5,329,990 | 7/1994 | Chigira . | |
| 5,417,277 | 5/1995 | Le Gauyer . | |
| 5,586,600 | 12/1996 | Cribari . | |
| 5,622,220 | 4/1997 | Park et al. . | |

FOREIGN PATENT DOCUMENTS

| | | | |
|---|---|---|---|
| 2 681 421 | 3/1993 | France . | |
| 1 1961 218 | 7/1970 | Germany . | |
| 40 31 576 | 4/1992 | Germany . | |
| 19515420 | 10/1996 | Germany | 165/173 |
| 254931 | 7/1926 | United Kingdom | 29/890.052 |
| 2 090 652 | 7/1982 | United Kingdom . | |

*Primary Examiner*—Leonard R. Leo
*Attorney, Agent, or Firm*—Thelen Reid & Priest LLP

[57] ABSTRACT

A header tube for heat exchangers with a tube segment having slots which are perpendicular to the tube axis and spaced in the longitudinal direction and separated by webs, into which hollow flat pipes can be inserted and joined to the contact surface of the respective slot. The webs each have a pair of stampings to strengthen the material on each side of each web and the webs are shaped largely flat such that the cross-section of the tube segment has a largely D-shaped profile. A method of manufacturing the header tubes is also presented.

17 Claims, 2 Drawing Sheets

FIG. 1
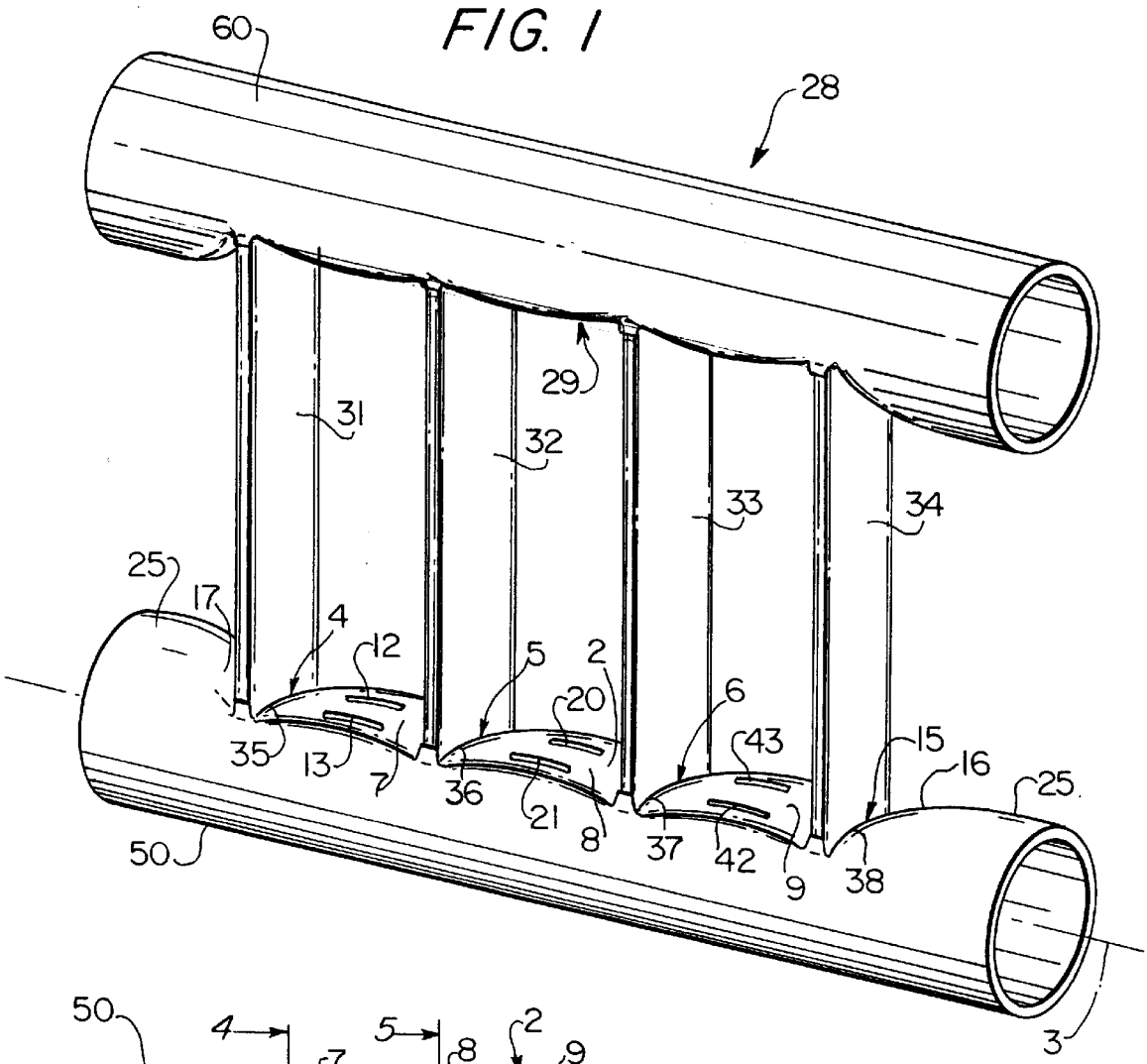
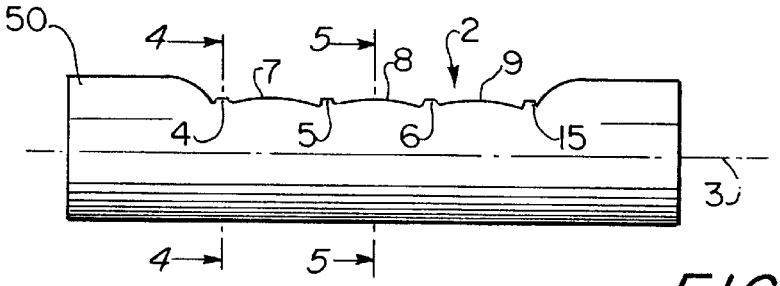
FIG. 2
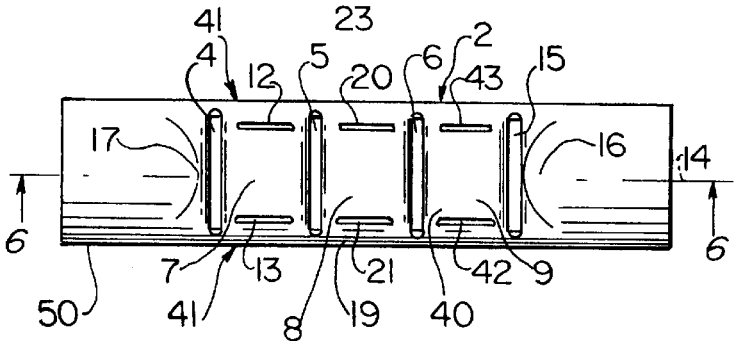
FIG. 3

HEADER TUBES FOR HEAT EXCHANGERS AND THE METHODS USED FOR THEIR MANUFACTURE

BACKGROUND OF THE INVENTION

1. Field of the Invention

The present invention relates generally to a header tube for heat exchangers. More specifically, the invention relates to header tubes that are strengthened by using stampings on each side of webs formed in the tubes and flattening the webs so that the cross-section of the tube has a D-shaped profile.

2. Related Art

In known types of header tubes, the stability of the webs in the transition to the cylindrical surface of the tube is achieved in some designs by lightly pressing down the middle of the webs at their highest point, until they are more or less flat or have a concave shape toward the inside of the tube. However, the change of direction of the surface toward the inside of the tube only results in a change of the slope of the transition to the cylindrical surface of the tube.

Other designs have transverse separating walls within the tube which are perpendicular to the tube axis, whereby each transverse wall radially supports one of the webs. The installation of the transverse walls to stabilize and hold the webs results in additional time and cost factors.

Another type of header tube is described in European Patent Document EP 0 198 581 81, which concerns a heat exchanger with header tubes that are spaced apart and largely parallel to each other. Each of the header tubes has spaced holes in the shape of slots which are perpendicular to the tube axis and separated by webs of metal.

The slots in the tube segment of one of the header tubes are arranged to be directly opposite corresponding slots in the other header tube. Hollow, flat pipes are installed between the header tubes and inserted in the associated slots, to be rigidly attached to the slots by soldering the contact surfaces such as by soldering. Each of the webs is convex, both across the header tube and also along the direction of the tube axis, having a largely curved surface, i.e., the parts of the tube segment between the slots are shaped as a dome.

In order to improve the poor strength of the curved webs of metal in their transition to the cylindrical surface of the tube, the edges of the slots, which are parallel to the flat pipes are folded over perpendicular to the tube axis. Shaping the slots in this way represents an additional time and cost factor during manufacture.

When the heat transfer fluid flows through the heat exchanger, this can result in pressure fluctuations which are transferred to the domed webs as vibration or shock waves, which can endanger poorly soldered connections between the flat pipes and the header tubes.

SUMMARY OF THE INVENTION

The present invention concerns a header tube for heat exchangers with a tube segment having a number of slots parallel to the tube axis and separated by webs of metal, whereby a hollow, flat pipe is inserted into each slot and secured by joining along the peripheral surface of contact with the slot by such methods as soldering, brazing, welding or epoxying.

A tube segment with a number of slots forms the end chamber of a header tube for a heat exchanger. The slots are designed to accept flat pipes which also serve as spacers between the two header tubes of the heat exchanger, and are designed in particular to carry a heat exchanger fluid which flows through under high pressure. The fluid may be a liquid, a gas or a mixture thereof.

It is already known that the transitions from the webs of metal between the slots to the cylindrical surface of the tube are critical locations for the mechanical strength, and can affect the durability of the heat exchanger. For this reason, the present invention relates to the manufacture of a header tube for a heat exchanger with a suitably-shaped tube segment with slots which allows easy insertion of a reliable mechanical support for flat pipes which are inserted during assembly, with easily joinable joints to guarantee a high strength of the transition between the webs and the cylindrical surface of the tube.

In the header tubes covered by the invention, the strength of the material is increased by stamping each side of each web with a stamping die. Furthermore, the webs are flattened such that the cross-section of the tube segment has a D-shaped profile. The stamping strengthens the webs, in particular, in their transition to the cylindrical surface of the tube. The stampings used to strengthen each web are preferentially stamped symmetrically on each side of the web in the outside quarters of the web which are furthest from the web centerline.

The two stamped areas on both sides of the web are preferably positioned symmetrically on each side of the web in the outside quarters of the web which are furthest from the web centerline. The stampings are presented as depressions in the surface and vary with respect to height, width, depth and shape. The stamping and the resulting depression of the surface causes the top half of the originally cylindrical surface of the header tube to become more or less flat. The equally spaced stampings, which are made parallel to the longitudinal axis of the tube segment, cause the webs of metal formed by the upper half of the header tube to be flattened in the direction of the tube axis.

As a result of their intended length in relation to the diameter of the header tube, the ends of the slots in the header tube have an angle of preferably to 30° to the x-axis of the tube cross-section on both sides of the tube centerline. The stampings on both sides of each web for strengthening the material lie on radials on each side of the tube axis with an angle $\beta$ of preferentially 40° to 60° to the x-axis of the tube cross-section, whereby the angle $\alpha$ of the ends of the associated slot is at least 10° less than the angle $\beta$.

The stampings for strengthening the material can be shaped as wide or narrow strips, can be angular, preferentially triangular, arranged along a spline, meandering or the like. In particular, each stamping can be formed as a single stamped spot or as a number of stamped spots which are spaced out along a straight line. The stamping, which extends more in the longitudinal direction than transversely, is arranged parallel to the longitudinal axis of the tube segment.

The stamped areas, which flatten the originally domed webs in the direction of the tube axis and are preferentially positioned symmetrically on each side of the webs in the outside quarters of the webs that are furthest from the web centerline, cause the entire tube segment to be flattened in the direction of the tube axis, whereby the width of the tube segment is roughly the same as the length of each of the slots. Accordingly, the tube segment is largely flat along its length, and forms a D-shape in cross-section together with the lower part of the tube segment which retains the cylindrical shape.

The slots are not manufactured as simple slots, but rather they have edges folded perpendicular to the tube axis towards the inside of the header tube. The two long edges of each slot which are folded perpendicular to the tube axis form largely flat surfaces that make good contact with the flat pipes which are inserted, since the flat pipes also have a largely flat outer surface. The folded over edges of the sides provide the advantage that the flat pipes can be easily inserted at the correct angle without tilting and the contact surfaces provided by the folded edges also serve to hold the flat pipes in position.

The ends of the slot edges at both ends of each slot are widened or enlarged at the side of the web to form flat lips that stabilize the transition to the cylindrical surface of the tube and provide additional support for the flat pipes which are inserted.

The contact surface between the slot edges and the sides of the respective flat pipes are formed such that, during joining, a fillet of filler material which is largely on the same plane can form around the entire periphery of the pipe. Examples of filler material are solder, brazing alloy and epoxy. The flattened tube segment is bounded at both ends in an axial direction by a sloping transition from the unchanged upper cylindrical surface of the header tube. The header tubes consist of metal, such as but not limited to a light alloy. Preferentially the header tubes are made from aluminum or from a light alloy containing aluminum, copper and for brass.

The method used to manufacture a header tube for a heat exchanger as covered by the invention is as follows:

The metal header pipe is supported on the outside along its length with a form-locking clamp. Equally spaced slots are then punched into the tube perpendicular to the tube axis such that at least one web is formed between adjacent slots. Following this, two areas are stamped towards the outside of each web and equidistant to the centerline of the web such that the cross-section of the tube segment now largely forms a D-shape profile.

The stamped areas which strengthen the material are preferentially positioned symmetrically on each side of the web in the outside quarters of the webs. The outside quarters are located furthest from the web centerline.

In order to make it easier to achieve the required D-shaped profile, the webs can be flattened down in the direction of the tube axis by applying pressure before stamping is done.

When shaping the tube segment and in particular when flattening the tube segment, the header tube should remain clamped with the form-locking support until all of the flattening resulting from the stamping and all of the strengthening of the webs has been completed. The stamping results in a significant strengthening of the tube segment, particularly in the transition from the webs to the original cylindrical surface of the tube.

BRIEF DESCRIPTION OF THE DRAWINGS

The present invention is better understood by reading the following Detailed Description of the Preferred Embodiments with reference to the accompanying drawing figures, in which like reference numerals refer to like elements throughout, and in which:

FIG. 1 is a perspective view of a heat exchanger with two header tubes in accordance with the present invention.

FIG. 2 is a side view of one of the header tubes shown in FIG. 1.

FIG. 3 is a plan view of the tube segment of the header tube as shown in FIG. 1.

DETAILED DESCRIPTION OF THE PREFERRED EMBODIMENTS

Figure 6:
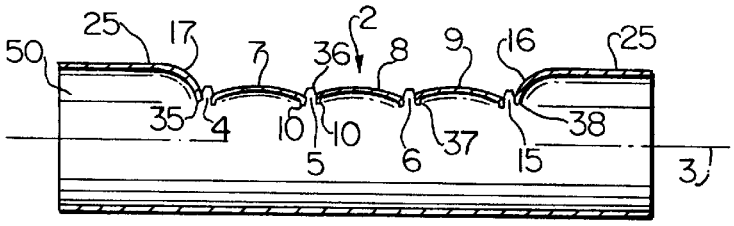
FIG. 6 is a longitudinal section along line C—C of FIG. 2 showing a tube segment which is flattened in the longitudinal direction.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

FIG. 1 shows a perspective view of a heat exchanger with two header tubes 50 and 60 embodying the teachings of the present invention. The two header tubes 50 and 60 are spaced apart and are essentially parallel to each other. The header tube 50 has a tube segment 2 with slots 4, 5, 6 and 15. Each of the slots is perpendicular to the tube axis 3 and separated by webs 7, 8 and 9.

The slots 4, 5, 6 and 15 in the tube segment 2 of the header tube 50 are arranged to be opposite the corresponding slots in the tube segment 29 of the other header tube 60. Hollow, flattened pipes 31, 32, 33 and 34 are inserted between the header tubes 50 and 60 in the respective slots 4, 5, 6 and 15. The flattened pipes 31 to 34 inserted in the header tube 50 are joined to the contact surfaces 35, 36, 37 and 38 of the slots 4, 5, and 15 respectively by such methods as soldering, brazing, welding or epoxying.

The following description primarily concerns header tube 50 since the same applies to header tube 60 due to the symmetry of the design.

FIG. 2 is a side view of header tube 50 of heat exchanger 28 as covered by the invention. The header tube 50 of the heat exchanger 28 has a tube segment 2 with slots 4, 5, 6 and 15 which are perpendicular to the tube axis 3 and spaced apart by the webs 7, 8 and 9.

FIG. 3 is a plan view of tube segment 2 of header tube 50 in which the webs 7, 8 and 9 between the slots 4, 5, 6 and 15 have stamped areas to strengthen the material. These stamped areas are positioned in each half 39 and 40 of the web and are parallel to the longitudinal axis 14. The stamped areas are shown as the narrow stamped strips 12, 13 and 20, 21 and 42, 43. The narrow stamped strips 12, 13 and 20, 21 and 42, 43 strengthen the webs 7, 8 and 9 in the transition region 19, 23 from the web to the side cylindrical surface of the tube 41. The stamped strips 12, 13 and 20, 21 and 42, 43, which strengthen the material, are represented as depressions in the webs 7 through 9. The depressed, stamped areas 12, 13 and 20, 21 and 42, 43 can also each be made as a stamped spot. The stamped areas can be preferentially made from a number of stamped spots which are spaced out along a straight line.

Figure 4:
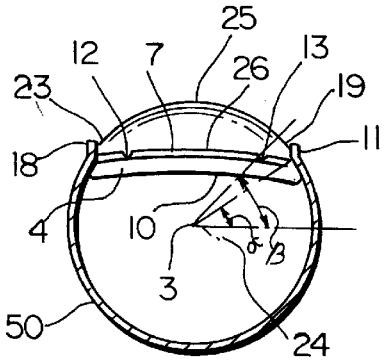
FIG. 4 is a section along line A A of FIG. 2 which passes through one of the slots of the tube segment of the header tube.

FIG. 4 shows a section of header tube 50 along line A—A in FIG. 2 through slot 4 of the tube segment 2. As with the other slots 5, 6 and 15, slot 4 has flat edges 10 which are folded over towards the inside of the tube to improve the contact surface to the associated flat pipes 31, 32, 33 and 34 which are inserted into the slots.

Each slot edge 10 is spread out or enlarged in a radial direction towards the respective sides of the web 7 to form flat lips 11 and 18 which also improve the strength of the transition 19 and 23 to the cylindrical surface of the tube 41. The same is true for the slot edges 10 of the other slots 5, 6 and 15. Due to the chosen length of the slot in relation to the diameter of the tube 50, the ends of the slots 4 have a slot end angle α on both sides of the tube axis 3 of preferentially 30° to the x-axis 24 of the cross-section (FIG. 4).

Figure 5:
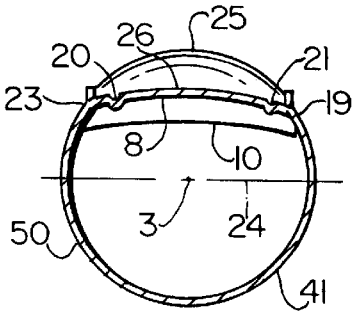
FIG. 5 is a section along line B—B of FIG. 2 which passes through one of the webs of the tube segment of the header tube.

The stampings 12, 13 in FIG. 4 and 20, 21, in FIG. 5 are found on both sides of each web for strengthening the material. The stampings lie on radials on each side of the tube. Each of the radials preferably has an angle β of approximately 60° to the x-axis of the cross-section 24 of tube 41. Stampings can also be positioned along a smaller radial angle β of e.g. 40° to 45° and thus, as contemplated by the invention, a radial angle β of preferentially 40° to 60° can be used when the slot end angle α is approximately 30°.

Due to the pairs of stamped areas 12, 13 and 20, 21 and 42, 43 which are made simultaneously on the webs 7, 8 and 9 respectively, the original cylindrical shape 25 of the webs 7, 8 and 9 now have a shortened and also flattened surface 26, which has been displaced radially towards the centerline 3 of the header tube.

According to the radial angle β at which the stamping die is applied to the tube surface 41 at the start of stamping and the depth of the stamped areas 12, 13 and 20, 21 and 42, 43, the webs 7, 8 and 9 between the pairs of stamped areas 12, 13 and 20, 21 and 42, 43 are more or less flattened, and thus the pairs of stamped areas on each side modify the upper, originally cylindrical shape of the outer surface of the tube 25 to a more or less flattened surface 26 at each of the webs 7, 8 and 9.

FIG. 5 is a section through the line B—B in FIG. 2 which passes through the centerline 22 in FIG. 2 of the web to show the web of the tube segment 2. The web 8 with the stamped areas 20 and 21 also have a D-shaped profile.

As already visible in FIGS. 4 and 5, the straight edges 10 of the slot 4 which are folded towards the axis of the tube also form a D-shape together with the cylindrical surface 41 of the lower part of the header tube 50.

FIG. 6 is a longitudinal section of tube 50 along the line C—C in FIG. 3. The header tube 50 has a flattened tube segment 2 which is bounded at both ends by the axially sloping transitions 16 and 17. The transitions 16 and 17 start from the outer cylindrical surface of the tube 25 and progress to the flattened region of the tube segment, the flatness of which is only affected slightly by the slight doming of the webs 7, 8 and 9 between the slots 4, 5, 6 and 15. Accordingly, the tube segment 2 represent a strong and largely flat depression of the tube.

The two regions web/slot/web and web/slot/transition have a finnel shape which allows the flat pipes 31, 32, 33 and 34 to be inserted more easily without tilting.

Each slot 4, 5, 6 or 15 has a pair of slot edges along the length of the slot which edges are essentially parallel to each other and folded towards the inside of the tube to form peripheral contact surfaces 35, 36, 37 and 38 which represent easily joinable surfaces when in contact with the outer surface of each of the flat pipes 31, 32, 33 and 34 in FIG. 1.

The contact surfaces between the parallel slot edges 10, including the ends of the slots 4, 5, 6 and 15 and the associated peripheral surfaces on the outside of the flat pipes 31, 32, 33 and 34, mate with each other in such a way that they can be joined together with a filet of filler material around each pipe which is largely on the same plane. Examples of filler material are solder, brazing alloy and epoxy.

To summarize, the slots 4, 5, 6 and 15 are preferentially made with flat edges on all sides to allow a continuous and easily joinable contact to the outside of the flat pipes 31, 32, 33 and 34 which are inserted.

Figure 7:
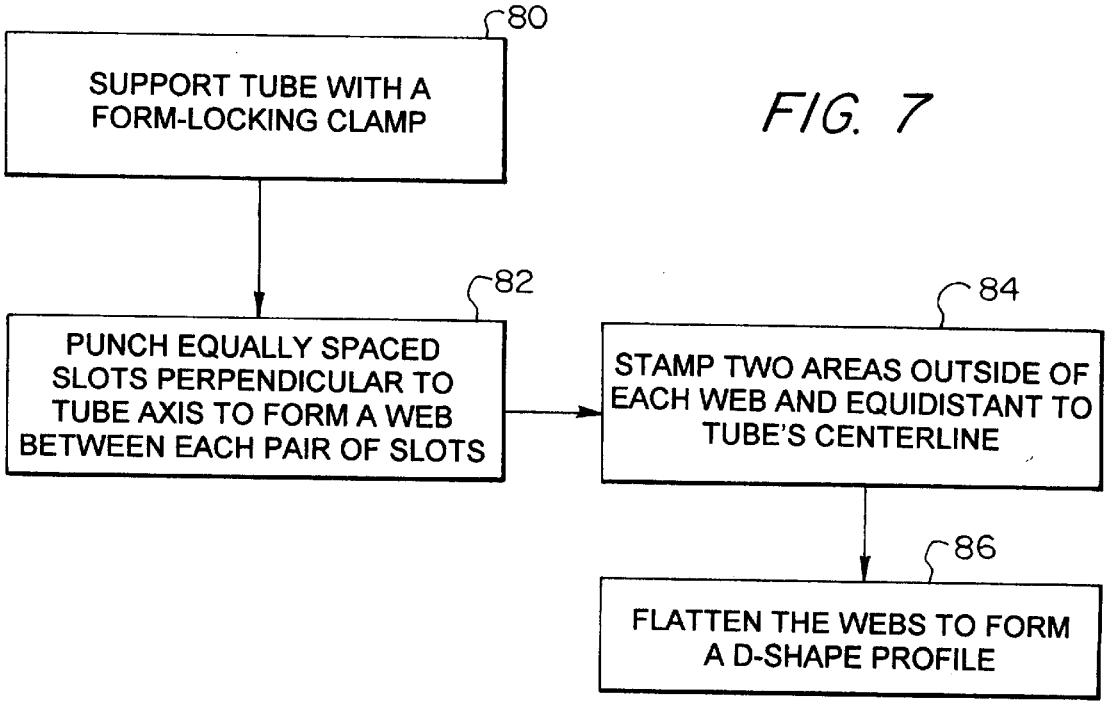
FIG. 7 is a flow chart showing the steps for making a header tube according to the teachings of the present invention.

The manufacture of the header pipes 50 and 60 as described in the invention with reference to FIG. 7 can take place with the following method, which is also covered by the invention. Due to the symmetry of the design, only the manufacture of header tube 50 will be described with the understanding that the same applies to tube 60.

With reference to step 80, a metal tube 50 preferentially made of aluminum is supported on the outside over its length by a form-locking clamp. According to step 82, slots 4, 5, 6 to 15 which are perpendicular to the longitudinal axis 14 are punched out to form the webs 7, 8 and 9. Following that in step 84, equally spaced pairs of stamped areas, 12, 13 and 20, 21 and 42, 43 are then stamped in both halves 39 and 40 of each 7, 8 and 9 parallel to the longitudinal axis 14, to displace the originally cylindrical outer surface of tube 25 radially in the direction of the tube axis and, according to step 86, cause it to flatten, such that the cross-section of the tube segment 2 largely has a D-shaped profile.

The metal tube 50 should be preferentially supported on the outside surface 41 in a form locking-clamp, particularly in the vicinity of the ends of the slots 4, 5, 6 and 15. The pairs of depressed areas caused by the stamping 12, 13 and 20, 21 and 42, 43 and which strengthen the material are preferentially positioned in the outside quarters of the webs 7, 8 and 9. The outside quarters are positioned furthest from the web centerline.

In order to simplify achieving the required D-shape profile, the webs 7, 8 and 9 can be preferentially flattened with the use of pressure in the direction of the tube axis 3 before stamping the areas 12, 13 and 20, 21 and 42, 43. The stamped areas, 12, 13 and 20, 21 and 42, 43 in the webs 7, 8 and 9 of the tube segment 2 are preferentially made in a single stamping process.

The D-shaped cross-section of the tube segment 2 ensures a rigid connection between the header tubes 50 and 60 and flat pipes 31 to 34. This rigid connection is strong enough to allow heat transfer fluid to flow through under high pressure. The invention and in particular the stamped areas 12, 13 and 20, 21 and 42, 43 ensure a considerable increase in the strength of the critical places in the transitions 19 and 23 between the webs 7, 8 and 9 and the cylindrical surface of the tube 41. This has an advantageous affect on the durability of the heat exchanger 28.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A header tube comprising:

an elongated tube segment;

a plurality of spaced slots being formed in said tube segment, each of said slots being essentially perpendicular to the longitudinal axis of said tube segment;

a plurality of webs defined in said tube segment, each of said webs being located between a pair of adjacent slots;

a plurality of stampings defined in each of said webs; and said webs being flattened so that said tube segment has a generally D-shaped profile in cross-section in the vicinity of the tube segment where the web is flattened.

2. A header tube according to claim 1, wherein the stampings in pairs are preferentially made in the outside quarters of the web which are furthest from the web centerline.

3. A header tube according to claim 1, wherein the stampings are shaped as wide or narrow strips, angular, preferentially triangular, arranged along a spline, and/or meandering.

4. A header tube according to claim 1, wherein the stampings are equally spaced and parallel to the tube segment, and displace the webs in the upper part of the tube segment in the direction of the tube axis 3 and thereby flatten the webs.

5. A header tube according to claim 1, wherein the stampings are each shaped as a spot or from a number of stamped spots which are spaced along a straight line.

6. A header tube according to claim 1, wherein each slot has two ends and each end of the slots has a slot end angle $\alpha$ of preferentially 30° to the x-axis (24) of the cross-section, on each side of the tubes axis 3, as a result of the chosen length of the slots in relation to the diameter of the tube.

7. A header tube according to claim 1, wherein the pair of stampings are positioned on a radial of angle $\beta$ of preferentially 40° to 60° to the x-axis of the cross-section (24) on each side of the tube axis (3), whereby by the ends of the associated slots each have a slot end angle a of at least 10° less than the angle $\beta$.

8. A header tube according to claim 1, wherein the stampings form depressions in the webs.

9. A header tube according to claim 1, wherein the ends of the slot edges (10) are expanded to flat lips (11, 18) towards the outside of each web which stabilize the transition (19, 23) to the cylindrical surface of the tube (41).

10. A header tube according to claim 1, wherein the tube segment is bounded in the axial direction by transitions (16, 17) which slope down from the cylindrical surface of the tube segment.

11. A header tube according to claim 1, wherein the entire tube segment is shaped as a flattened depression, the width of which is about the same as the lengths of the slots.

12. A header tube according to claim 1, wherein at least one slot has a pair of parallel slot edges along its length which are folded down towards the inside of the tube to form a peripheral contact surface which makes it easy to make a joined connection to the periphery of a flat pipe slot which is intended to be received in said slot.

13. A header tube according to claim 1, wherein the peripheral contact surfaces (35, 36, 37, 38) along the slot edge (10) and the ends of the slots (4, 5, 6, 16) and the matching peripheral contact surface around the flat pipes are constructed to come into close contact when the pipe is inserted.

14. A header tube according to claim 1, wherein the contact surfaces along the parallel slot edges (10) of the slot and the corresponding peripheral surface of the flat pipe are so constructed that a fillet of filler material can be placed around the entire periphery.

15. A method of making a header tube, the method comprising the steps of:

supporting a tube segment;

forming a plurality of slots in the tube segment, each of the slots being essentially perpendicular to the longitudinal axis of the tube segment;

forming a plurality of webs in the tube segment, each of the webs being located between a pair of adjacent slots;

creating stampings in each web; and flattening each web so that the tube segment has a generally D-shaped profile in cross-section in the vicinity of the tube segment where the web is flattened.

16. The method according to claim 15, wherein in said creating step, the stamping are depressed (12, 13; 20, 21; 42, 43) which strengthen the material and are made in the suitable quarters of the web (7, 8, 9) which are furthest from the web centerline.

17. The method according to claim 15, wherein in the flattening step, the webs are flattened in the direction of the tube axis (3) by applying pressure before the creative step.

* * * * *